US005713490A

United States Patent [19]

Oden et al.

[11] Patent Number: 5,713,490

[45] Date of Patent: Feb. 3, 1998

[54] ADJUSTABLE VENDING MECHANISM

[75] Inventors: Kenneth W. Oden, Charles Town; Michael D. Ring, Kearneysville, both of W. Va.

[73] Assignee: Royal Vendors, Inc., Kearneysville, W. Va.

[21] Appl. No.: 629,517

[22] Filed: Apr. 9, 1996

[51] Int. Cl.[6] ..... B65H 31/20

[52] U.S. Cl. ..... 221/242; 221/289

[58] Field of Search ..... 221/241, 242, 221/67, 299, 289, 266, 194, 301

[56] References Cited

U.S. PATENT DOCUMENTS

| | | | |
|---|---|---|---|
| 2,308,532 | 11/1943 | Mills | 221/62 |
| 3,104,779 | 9/1963 | Denzer | 221/200 |
| 3,338,470 | 8/1967 | Newberry | 221/241 |
| 3,361,505 | 1/1968 | Newberry | 221/242 |
| 3,757,998 | 9/1973 | Millies et al. | 221/242 |
| 3,810,560 | 5/1974 | Stegeman | 221/116 |
| 4,852,767 | 8/1989 | Humphrey | 221/241 |

*Primary Examiner*—Kenneth Noland
*Attorney, Agent, or Firm*—Reid & Priest L.L.P.

[57] ABSTRACT

An adjustable mechanism for vending products includes left and right column walls defining a column divided into front and rear sections for retaining the products in front and rear corded stacks. A rear spacer provided at the back side of the column is laterally adjustable relative to the front side of the column to accommodate products of different lengths in the rear section. Front and rear product funnels are positioned respectively in the front and rear sections above the bottom end of the column, with front and rear adjustable product ramps interposed between the outlets of the front and rear product funnels, respectively, and the open bottom end of the column. The front and rear adjustable product ramps are independently pivotable about their pivot axes in response to movement of front and rear adjustment rods to change the width of the open bottom of the column at the front and back sections to accommodate products of different diameters. Front and rear rotatable cradles are positioned below the outlets of the front and rear product funnels, respectively, to releasably support the bottommost products in the front and rear corded stacks, and are independently rotatable to vend products independently from the front and rear stacks. The cradles are rotated by front and rear motors drivingly connected to the front and rear rotatable cradles, respectively. The front and rear adjustment rods each have a forward end formed into a handle which extends forwardly of the front side of the column through a cover plate covering the front side of the column. The cover plate includes a gauge thereon indicating positions of the handles corresponding to preselected product sizes. The cover plate can further include a size gauge for measuring the size of an article.

16 Claims, 3 Drawing Sheets

ADJUSTABLE VENDING MECHANISM

BACKGROUND OF THE INVENTION

1. Field of the Invention

The present invention relates to vending machines. More specifically, the invention relates to a vending mechanism for vending machines which is adjustable so that different magazines within a single vending machine can accommodate cans and/or bottles of different sizes.

2. Related Art

Vending machines incorporating magazines which are adjustable to accommodate articles or products of different sizes are known in the art. For example, Millies et al. (U.S. Pat. No. 3,757,998) discloses a vending machine which includes means, e.g. adjustable side wall attachment units 36*a* and 36*b*, for adjusting the width and length of the magazines, to adapt the machine to dispensing of articles of different lengths and widths. Units 36*a* and 36*b* are formed with accordion-like folds, so that they can be folded flat or expanded, depending upon the size of the articles. They can also be adjusted vertically, to change the plane of ejection in accordance with the thickness of the article. Articles are ejected by an ejector finger 40 controlled by a solenoid 46. Newberry (U.S. Pat. No. 3,361,505) discloses a vending machine with multiple storage columns, each of which has first and second vertically positioned spaced side guide members (50 and 60, and 70 and 80, and 90 and 100) with adjustment means to simultaneously adjust both the vertical and horizontal position of one of the guide members, while the other of the guide members remains fixed.

Newberry (U.S. Pat. No. 3,338,470) discloses with respect to FIGS. 9 and 10 a vending machine having a corded stack column structure with side walls 11 and 12 provided at their lower ends with converging curved can guides 54. Each column of the corded stack is in reality a tandem stack of front and back corded stack columns. The release mechanisms for the front and back stack columns are positioned on a single shaft, and are configured alternately to release an article from first the front then the back stack column. Each can guide 54 comprises two parts 55 and 56 which are adjustable relative to each other to accommodate cans of different sizes. The overlapping portions of parts 55 and 56 are provided with three sets 59, 60, and 61 of openings which when placed in registration can be secured by screws 62 to achieve the desired adjustment.

Denzer (U.S. Pat. No. 3,104,779) discloses an article-vending magazine having a rotating shaft at the bottom driven by a geared motor. A plurality of spaced star wheels 68 and circumferentially spaced vanes 78 mounted on the shaft are used to vend articles from the bottom of the magazine. The shaft is driven by a gear motor 72.

Likewise, as shown by the Newberry '505 patent, the prior art includes means for obtaining a predetermined adjustment position of a movable magazine side wall. The adjustment means, described with respect to guide members 50 and 90, can comprise a pair of extension members 51 and 52 to which are secured respective pins 53 and 54. A supporting strip 55 is fixedly secured to the fixed guide member and is provided with inclined slots 56, 57 in which the pins 53, 54 are respectively received. Alignment apertures 120, 121, 122 can be provided on the support strip, with corresponding alignment apertures 130, 131, 132 provided in the extension of the adjustable guide. A gating mechanism such as a star wheel is provided at the lower end of each column for vending the articles one at a time.

However, the prior art adjustment mechanisms require access to the interior of the vending mechanism to perform the adjustment, and adjustment tends to be complicated and time-consuming. Further, the prior art adjustment mechanisms provide the service person either with limited adjustments or little guidance in choosing the correct adjustment among several available adjustments.

It is the solution to these and other problems to which the present invention is directed.

SUMMARY OF THE INVENTION

It is therefore a primary object of the present invention to provide an adjustable vending mechanism which permits adjustments to be made from the exterior of the mechanism.

It is another object of the present invention to provide an adjustable vending mechanism which can accommodate articles in a variety of sizes.

It is still another object of the present invention to provide an adjustable vending mechanism which provides the service person with guidance in choosing the correct adjustment.

It is still another object of the present invention to provide an adjustable vending mechanism in association with other adjustable vending mechanisms of like kind to form an adjustable vending mechanism assembly.

These and other objects of the present invention are achieved by the provision of an adjustable mechanism for vending products or articles arranged in front and rear corded stacks and having parallel longitudinal axes. The mechanism includes left and right column walls defining a column for retaining the products in a corded stack, the column having an open bottom end, a front side, and a back side. The column is divided into front and rear sections which can accommodate products of different sizes. A rear spacer can be provided at the back side of the column, the rear spacer being forwardly and rearwardly adjustable relative to the front side of the column to accommodate products of different lengths.

Front and rear product funnels are positioned respectively in the front and rear sections above the bottom end, with front and rear adjustable product ramps interposed between the outlets of the front and rear product funnels, respectively, and the open bottom end of the column. The front and rear adjustable product ramps are independently pivotable about respective pivot axes parallel to the longitudinal axes of the products.

Front and rear adjustment rods are provided in engagement with the front and rear adjustable product ramps, respectively. The front and rear adjustable product ramps pivot about their pivot axes in response to movement of the adjustment rods to change the width of the open bottom of the column at the front and back sections to accommodate products of different sizes.

Front and rear rotatable cradles are positioned below the outlets of the front and rear product funnels, respectively, to releasably support the bottommost products in the front and rear corded stacks. The front and rear cradles are freely rotatable independently of each other on a shaft having a longitudinal axis parallel to the longitudinal axes of the products, so that products can be vended independently from the front and rear stacks. The cradles are rotated by front and rear motors drivingly connected to the front and rear rotatable cradles, respectively.

In one aspect of the invention, front and rear fixed product ramps are provided in communication with the outlets of the front and rear product funnels, the front and rear cradles being positioned adjacent the respective trailing edges of the front and rear fixed product ramps. Front and rear ramp covers extend downwardly from the front and rear product funnels, respectively, in spaced apart relation to the front and rear fixed product ramps, respectively. The front and back adjustable product ramps are respectively pivotably mounted to the trailing edges of the front and rear ramp covers.

In another aspect of the invention, the front and rear adjustment rods each have a forward end extending forwardly of the front side of the column, the forward end being formed into a handle. The handles extend through a cover plate covering the front side of the column, which cover plate includes a gauge thereon indicating positions of the handles corresponding to preselected product sizes. The cover plate can further include a size gauge for measuring the size of a product.

BRIEF DESCRIPTION OF THE DRAWINGS

The invention is better understood by reading the following Detailed Description of the Preferred Embodiments with reference to the accompanying drawing figures, in which like reference numerals refer to like elements throughout, and in which.

DETAILED DESCRIPTION OF THE PREFERRED EMBODIMENTS

Figure 1:
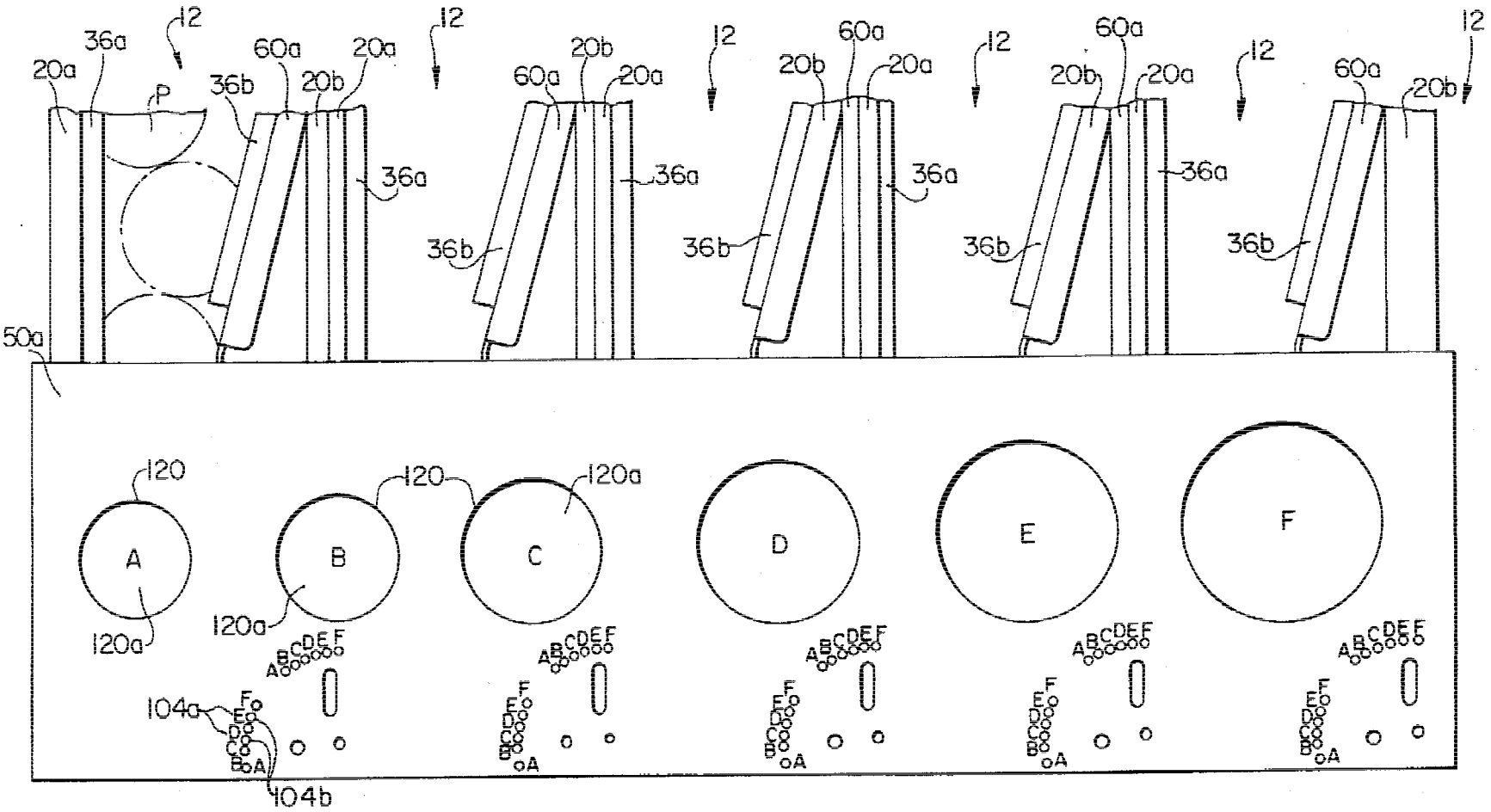
FIG. 1 is a front plan view of an adjustable vending mechanism assembly in accordance with the present invention, with its front mechanical plate in place.

In describing preferred embodiments of the present invention illustrated in the drawings, specific terminology is employed for the sake of clarity. However, the invention is not intended to be limited to the specific terminology so selected, and it is to be understood that each specific element includes all technical equivalents which operate in a similar manner to accomplish a similar purpose.

Referring now to FIG. 1, there is shown an adjustable vending mechanism assembly 10 in accordance with the present invention for vending products P in forward and rearward corded stacks. It is contemplated that the adjustable vending mechanism assembly 10 can be used in a vending machine of the type incorporating an electronic refrigeration control system as described in co-pending application Ser. No. 08/322,978, filed Oct. 13, 1994, which is incorporated herein by reference in its entirety.

The products P with which the adjustable vending mechanism assembly 10 is to be used are circular in transverse cross-section, and can be cans or bottles of different widths and heights. Examples of such cans or bottles include, but are not limited to 9 ounce water bottles, "all sport" bottles, 20 ounce bottles, and 12 ounce cans.

The adjustable vending mechanism assembly 10 comprising a plurality of adjustable vending mechanisms 12. In the vending mechanism assembly 10 as shown in FIG. 1, there are six banks of forward and rearward corded stacks, each with its own adjustable vending mechanism 12. However, as will be appreciated by those of skill in the art, the number of banks can be increased or decreased in accordance with the actual application of the vending machine itself.

Figures 2, 3:
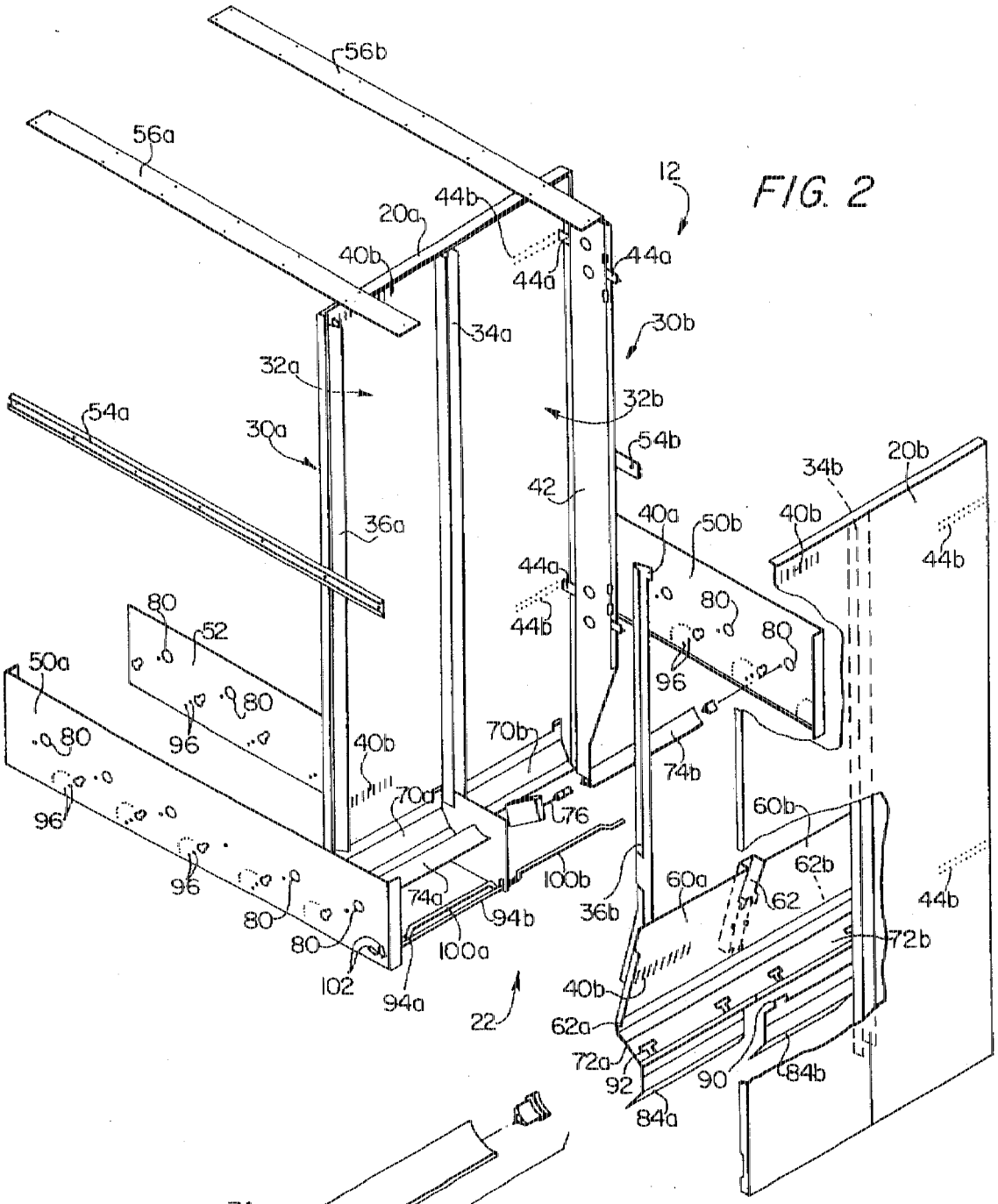
FIG. 2 is a partially-exploded perspective view, with parts broken away, of one of the adjustable vending mechanisms of the adjustable vending mechanism assembly of FIG. 1.
FIG. 3 is an exploded perspective view of the rotatable cradle of the adjustable vending mechanism of FIG. 2.

Referring now to FIG. 2, each bank and its associated adjustable vending mechanism 12 is enclosed by left and right column walls 20*a* and 20*b* defining a column having an open bottom end 22, an open top end 24, a front side 30*a*, front and rear sections 32*a* and 32*b*, and a back side 30*b*. The column is divided into front and rear sections 32*a* and 32*b* by left and right column dividers 34*a* and 34*b* affixed respectively to the left and right column walls 20*a* and 20*b*. The products P are retained within the front section 32*a* by left and right product retainers 36*a* and 36*b* affixed to the left and right column walls 20*a* and 20*b* at the front side 30*a* of the column. The positions of left and right product retainers 36*a* and 36*b* are independently forwardly and rearwardly adjustable to accommodate products P of different lengths in the front stack of each adjustable vending mechanism 12. As can be seen from FIG. 2, adjustment of the left and right product retainers 36*a* and 36*b* can be achieved through the use of a conventional mating tab 40*a* and slot 40*b* construction. However, as will be appreciated by those of skill in the art, other constructions which permit adjustment can be used as well.

The products P are retained within the rear section 32*b* by a rear spacer 42, the position of which also is forwardly and rearwardly adjustable to accommodate products P of different lengths in the rear stack of each adjustable vending mechanism 12. As can be seen from FIG. 2, adjustment of the rear spacer 42 can be achieved through the use of a convention retractable pin 50*a* and slot 50*b* construction.

In addition, a front mechanical plate 50*a* extends across the front side front and rear sections 32*a* and 32*b* adjacent the bottom end 22, a back mechanical plate 50*b* extends across the back side 30*b* adjacent the bottom end 22, and a center support plate 52 extends between the left and right column walls 20*a* and 20*b* adjacent the bottom end 22 intermediate the front and rear mechanical plates 50*a* and 50*b*. In order to provide structural stability, the left and right column walls 20*a* and 20*b* are connected at the front and back sides front and rear sections 32*a* and 32*b* and 30*b* of the column by front and rear tie strips 54*a* and 54*b*, respectively, and at the top end 24 by top tie strips 56*a* and 56*b*.

Figure 5:
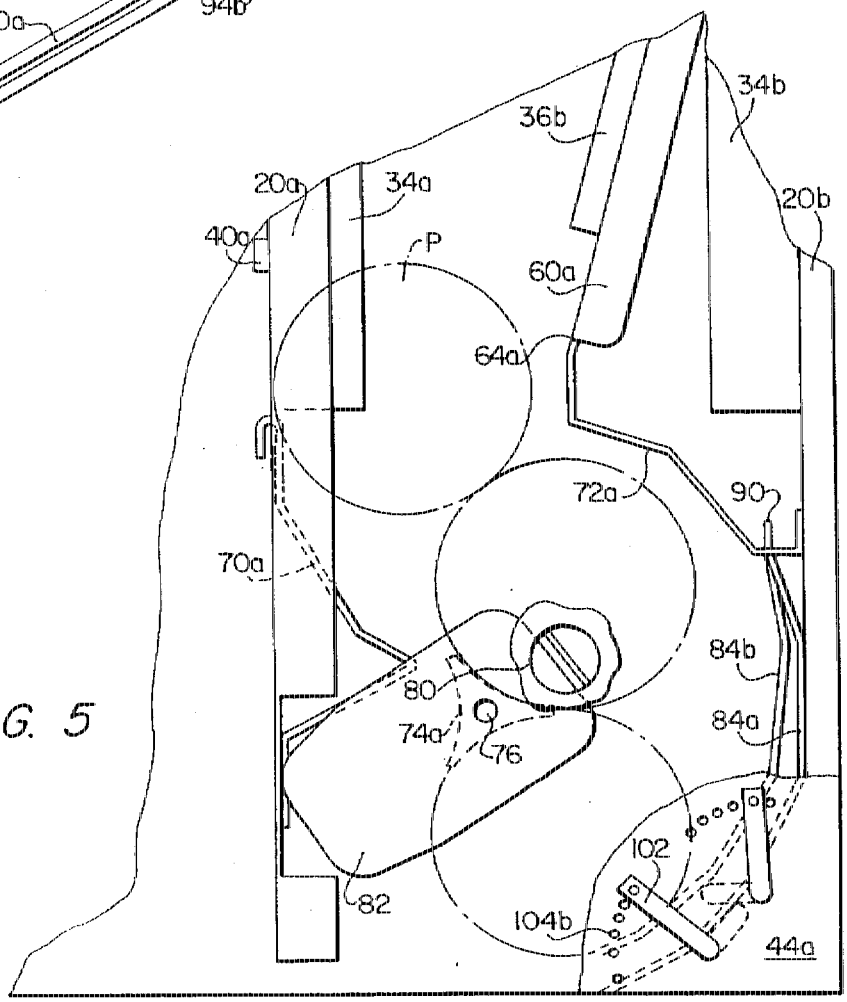
FIG. 5 is a partial side elevational view, with parts broken away, of the adjustable vending mechanism of FIG. 2.

Referring now to FIGS. 2 and 5, products P are diverted towards the open bottom end 22 of the column by front and rear product funnels 60*a* and 60*b* which are positioned in the front and rear sections 32*a* and 32*b* attached to the right column wall 20*b* above the bottom end 22. As illustrated in FIG. 2, the front and rear funnels 60*a* and 60*b* are formed from a single piece of material divided into front and rear sections by a funnel divider 62. However, as will be appreciated by those of skill in the art, the front and rear product funnels 60*a* and 60*b* could be formed as separate pieces.

The front and rear product funnels 60*a* and 60*b* have respective outlets 64*a* and 64*b* in communication with front and rear fixed product ramps 70*a* and 70*b*. The front and rear fixed product ramps 70*a* and 70*b* are affixed to the left column wall 20*a* to the front and rear of the left column divider 34*a*. Front and rear ramp covers 72*a* and 72*b* extend downwardly from and are formed integrally with the front and rear product funnels 60*a* and 60*b* in spaced apart relation to the front and rear fixed product ramps 70*a* and 70*b*.

Front and rear rotatable cradles 74*a* and 74*b* are positioned adjacent the trailing edges of the front and rear fixed product ramps 70*a* and 70*b*, respectively, to releasably support the bottommost products P in the front and rear corded stacks below the outlets 62a and 62b of the front and rear product funnels 60a and 60b. The front and rear rotatable cradles 74a and 74b are freely rotatable on a shaft 76 mounted in apertures through the front and rear mechanical plates and the center support plate 52, and have a longitudinal axis parallel to the longitudinal axes of the products P. The front and rear rotatable cradles 74a and 74b are rotatable independently of each other.

Cradles 74a and 74b are identical in configuration, and as best shown in FIG. 3 with respect to the front cradle 74a, they are generally triangular in cross-section with slightly concave sides. However, as will be appreciated by those of skill in the art, other structures, such as paddles or star wheels as shown respectively in U.S. Pat. No. 3,810,560 to Stegeman and U.S. Pat. No. 3,104,779 to Denzer (and which are incorporated herein by reference for their descriptions of such paddles and star wheels), can be substituted for front and rear cradles 74a and 74b.

Housings 82 for front and rear DC motors are mounted respectively on the front mechanical plate 50a and the center support plate 52. The front and rear motors are respectively drivingly connected to the front and rear rotatable cradles 74a and 74b by gear trains (not shown) within the housings 82. When a product is selected by a customer, the appropriate motor is energized, causing the corresponding cradle to rotate one-third of a turn (or an otherwise appropriate mount, if an alternative structure is used) to release the bottommost product.

Front and rear adjustable product ramps 84a and 84b are positioned at the trailing edges of the front and rear ramp covers 72a and 72b so as to be interposed between the outlets 62a and 62b of the front and rear product funnels 60a and 60b, respectively, and the open bottom end 22 of the column. The front and rear adjustable product ramps 84a and 84b are mounted to the trailing edges of the front and rear ramp covers 72a and 72b so as to be independently pivotable about respective pivot axes located at their upper edges and parallel to the longitudinal axes of the products P. As shown in FIGS. 2 and 5, tabs 90 are formed at the upper edges of the front and rear adjustable product ramps 84a and 84b, which are inserted into mating 92 slob formed in the trailing edges of the front and rear ramp covers 72a and 72b. However, as will by appreciated by those of skill in the art, any other means of mounting the front and rear adjustable product ramps 84a and 84b to the trailing edges of the front and rear ramp covers 72a and 72b can be used which will enable the front and rear adjustable product ramps 84a and 84b to pivot.

Figure 4:
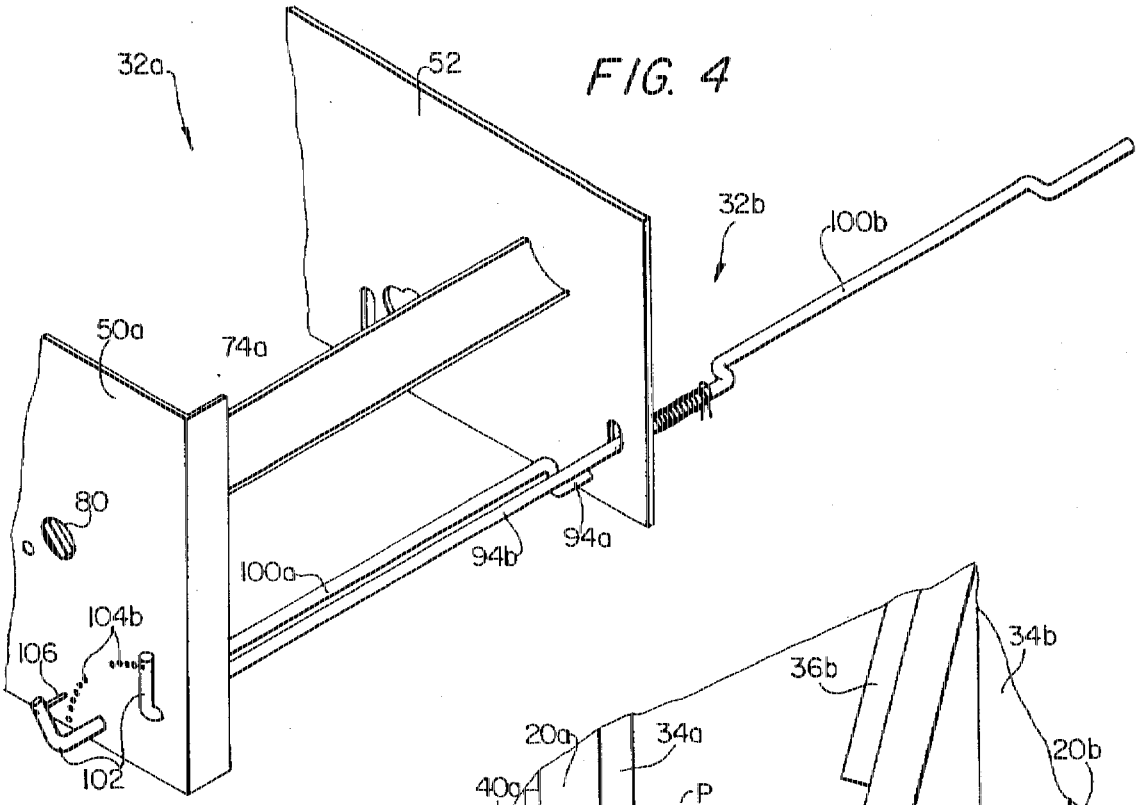
FIG. 4 is an enlarged partial perspective view of a portion of the adjustable vending mechanism of FIG. 2.

Referring now to FIGS. 2 and 4, adjustment of the front and rear adjustable product ramps 84a and 84b is achieved through the provision of front and rear adjustment rods 94a and 94b having longitudinal axes parallel to the longitudinal axes of the products P. The front and rear adjustment rods 94a and 94b are mounted in apertures 96 through the front and rear mechanical plates 50a and 50b and the center support plate 52 so as to rotate about their longitudinal axes, and are provided with respective projections 100a and 100b positioned to engage the front and rear adjustable product ramps 84a and 84b, respectively. The front and rear adjustment rods 94a and 94b each have a forward end 102 extending forwardly of the front mechanical plate 50a, the forward end being formed into a handle by which each of the front and rear adjustment rods 94a and 94b can be rotated. The front and rear adjustable product ramps 84a and 84b pivot about their pivot axes in response to rotation of the adjustment rods 94a and 94b to change the width of the open bottom end 22 of the column at the front and rear sections 32a and 32b to accommodate products of different sizes.

In a preferred embodiment of the invention, shown in FIG. 1, the front mechanical plate 50a includes a position gauge 104 thereon indicating positions of the handles corresponding to preselected product sizes, which are denoted by letters or numbers 104a. The gauge can incorporate a series of indentations or apertures 104b and the handles 102 can be provided with rearwardly projecting pins 106 (FIG. 4) for engaging the indentations or apertures 104b. The handles 102 can then be locked in place by inserting their pins 106 into a selected indentation or aperture 104b.

In this aspect of the invention, front and rear adjustment rods 94a and 94b are also movable along their longitudinal axes between a rearward, locked position and a forward, unlocked position in order to permit engagement with and disengagement from the indentations or apertures. Front and rear adjustment rods 94a and 94b are each provided with a coil spring 110 held in place by a spring clip 112 rearwardly of the center support plate 52, as shown in FIG. 4, for normally biasing front and rear adjustment rods 94a and 94b in the locked position. To operate the front and rear adjustment rods 94a and 94b, it is only necessary to pull them forward from their locked to their unlocked positions, rotate them into their desired angular positions corresponding to the sizes of products to be placed in the forward and rearward stacks, and then release them so that they return to their locked positions with their pins 106 engaging the appropriate indentations or apertures 104b.

Further, the front mechanical plate 50a can be provided with a size gauge for measuring the size of an article. The size gauge can, for example, comprise a series of different-sized circles or apertures 120 marked on or provided through the front mechanical plate 50a corresponding to the different sized products to be accommodated by the vending machine. Each circle or aperture 120 is marked with a letter or number 120a denoting its size and corresponding to one of the letters or numbers 104a on the position gauges 104.

Modifications and variations of the above-described embodiments of the present invention are possible, as appreciated by those skilled in the art in light of the above teachings.

It is therefore to be understood that, within the scope of the appended claims and their equivalents, the invention may be practiced otherwise than as specifically described.

What is claimed is:

1. An adjustable mechanism for vending products in a corded stack, the products having parallel longitudinal axes, said mechanism comprising:

left and right column walls defining a column for retaining the products in a corded stack, the column having an open bottom end, a front side, and a back side;

a product funnel positioned above said bottom end, said product funnel having an outlet;

an adjustable product ramp interposed between said outlet of said product funnel and said open bottom end of said column, said adjustable product ramp being pivotable about a pivot axis parallel to the longitudinal axes of the products;

an adjustment rod in engagement with said adjustable product ramp, said adjustable product ramp pivoting about its pivot axis in response to movement of said adjustment rod to change the width of said open bottom end of said column to accommodate products of different sizes;

a rotatable cradle below said outlet of said product funnel positioned to releasably support the bottommost product in the corded stack; and a motor drivingly connected to said rotatable cradle.

2. The adjustable mechanism of claim 1, further comprising a fixed product ramp in communication with said outlet of said product funnel, said fixed product ramp having a trailing edge and said cradle being positioned adjacent said trailing edge.

3. The adjustable mechanism of claim 2, further comprising a ramp cover extending downwardly from said product funnel in spaced apart relation to said fixed product ramp, said ramp cover having a trailing edge and said adjustable product ramp being pivotably mounted to said trailing edge of said ramp cover.

4. The adjustable mechanism of claim 1, further comprising a shaft having a longitudinal axis parallel to the longitudinal axes of the products, said cradle being freely rotatable on said shaft.

5. The adjustable mechanism of claim 1, wherein said adjustment rod has a forward end extending forwardly of said front side of said column, said forward end being formed into a handle, and wherein said adjustable mechanism further comprises a cover plate extending across said front side of said column with said handle extending therethrough, said cover plate including a position gauge thereon indicating positions of said handle corresponding to preselected product sizes.

6. The adjustable mechanism of claim 5, wherein said cover plate further includes a size gauge for measuring the size of an article.

7. The adjustable mechanism of claim 1, further comprising a rear spacer at said back side of said column, said rear spacer being forwardly and rearwardly adjustable relative to said front side of said column to accommodate products of different lengths.

8. The adjustable mechanism of claim 1, further comprising left and right product retainers at said front side of said column, said left and right product retainers being independently forwardly and rearwardly adjustable relative to said front side of said column to accommodate products of different lengths.

9. An adjustable mechanism for vending products in front and rear corded stacks, the products having parallel longitudinal axes, said mechanism comprising:

left and right column walls defining a column for retaining the products in a corded stack, said column having an open bottom end, a front side, and a back side, said column being divided into front and rear sections;

front and rear product funnels positioned respectively in said front and rear sections above said bottom end, said front and rear product funnels having respective outlets;

front and rear adjustable product ramps interposed between said outlets of said front and rear product funnels, respectively, and said open bottom end of said column, said front and rear adjustable product ramps being independently pivotable about respective pivot axes parallel to the longitudinal axes of the products;

front and rear adjustment rods in engagement with said front and rear adjustable product ramps, respectively, said front and rear adjustable product ramps pivoting about their pivot axes in response to movement of said adjustment rods to change the width of said open bottom of said column at said front and back sections to accommodate products of different sizes;

front and rear rotatable cradles below said outlets of said front and rear product funnels, respectively, positioned to releasably support the bottommost products in said front and rear corded stacks, said front and rear rotatable cradles being rotatable independently of each other; and front and rear motors drivingly connected to said front and rear rotatable cradles, respectively.

10. The adjustable mechanism of claim 9, further comprising front and rear fixed product ramps in communication with said outlets of said front and rear product funnels, respectively, said front and rear fixed product ramps having respective trailing edges and said front and rear cradles being positioned adjacent said trailing edges of said front and rear fixed product ramps, respectively.

11. The adjustable mechanism of claim 10, further comprising front and rear ramp covers extending downwardly from said front and rear product funnels, respectively, in spaced apart relation to said front and rear fixed product ramps, respectively, said front and rear ramp covers each having a trailing edge and said front and back adjustable product ramps being respectively pivotably mounted to said trailing edges of said front and rear ramp covers.

12. The adjustable mechanism of claim 9, further comprising a shaft having a longitudinal axis parallel to the longitudinal axes of the products, said front and rear cradles being freely rotatable on said shaft.

13. The adjustable mechanism of claim 9, wherein said front and rear adjustment rods each have a forward end extending forwardly of said front side of said column, said forward end being formed into a handle, and wherein said adjustable mechanism further comprises a cover plate covering said front side of said column with said handles extending therethrough, said cover plate including a gauge thereon indicating positions of said handles corresponding to preselected product sizes.

14. The adjustable mechanism of claim 13, wherein said cover plate further includes a size gauge for measuring the size of an article.

15. The adjustable mechanism of claim 9, further comprising a rear spacer at said back side of said column, said rear spacer being laterally adjustable relative to said front side of said column to accommodate products of different lengths.

16. The adjustable mechanism of claim 9, further comprising left and right product retainers at said front side of said column, said left and right product retainers being independently forwardly and rearwardly adjustable relative to said front side of said column to accommodate products of different lengths.

* * * * *